United States Patent [19]

Riggs

[11] 4,085,527

[45] Apr. 25, 1978

[54] ATHLETIC SHOE

[76] Inventor: Donnie E. Riggs, 1606 Monteval Ct., San Jose, Calif. 95120

[21] Appl. No.: 764,696

[22] Filed: Feb. 1, 1977

[51] Int. Cl.[2] ..... A43B 5/00; A43B 23/28; A43B 13/04

[52] U.S. Cl. ..... 36/114; 36/59 C; 36/32 R

[58] Field of Search ..... 36/59 R, 67 R, 67 A, 36/67 B, 67 C, 67 D, 126, 127, 128, 129, 134, 30 R, 32 R, 114

[56] References Cited

U.S. PATENT DOCUMENTS

| | | | |
|---|---|---|---|
| 2,185,397 | 1/1940 | Birchfield | 36/67 D |
| 3,466,763 | 9/1969 | Levin | 36/67 A |
| 3,793,750 | 2/1974 | Bowerman | 36/59 C |
| 3,918,181 | 11/1975 | Inohara | 36/59 C |
| 3,932,950 | 1/1976 | Taber | 36/59 R |

*Primary Examiner*—Patrick D. Lawson
*Attorney, Agent, or Firm*—Gerald L. Moore

[57] ABSTRACT

An athletic shoe particularly adapted to support the foot while the wearer is running, and having a particular cleat configuration on the sole for contacting the ground or running surface in a manner to both cushion the foot and leg of the wearer and provide improved traction as the heel strikes the surface.

7 Claims, 7 Drawing Figures

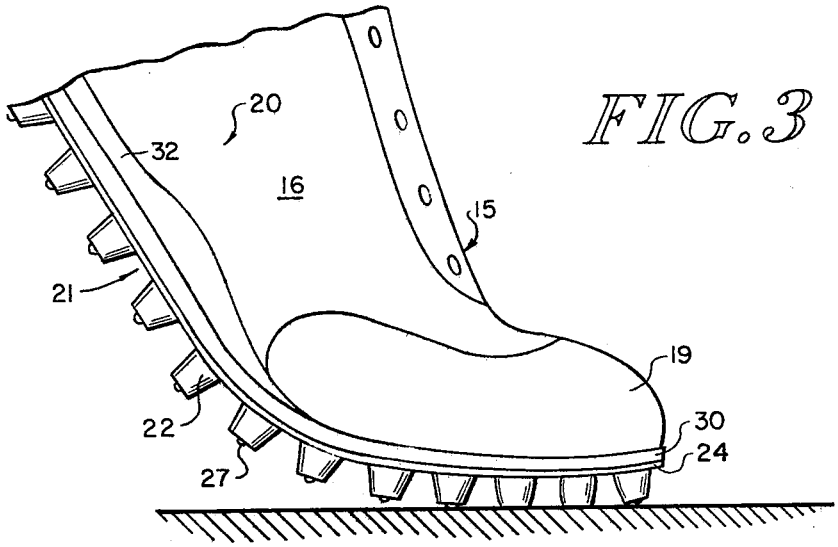
FIG. 3
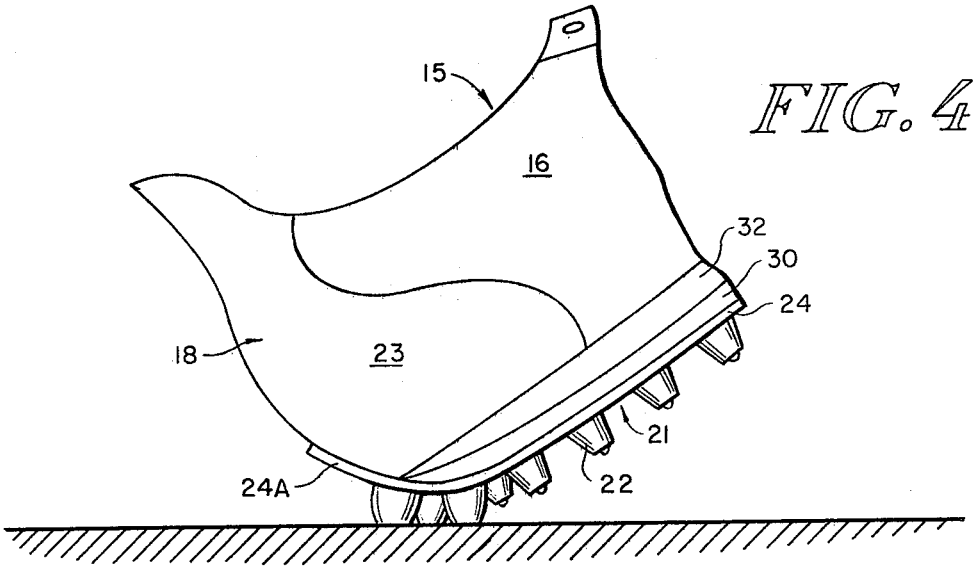
FIG. 4
FIG. 7
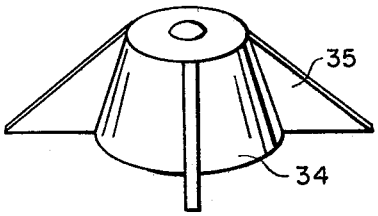
FIG. 8
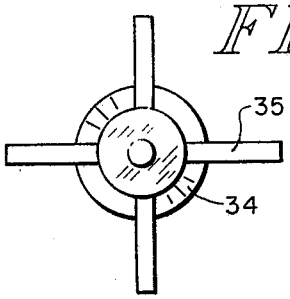

ATHLETIC SHOE

BACKGROUND OF THE INVENTION

When a runner places his lead foot on the ground the heel strikes first followed by a rolling action across the ball of the foot until the toe is in contact with the ground. The runner thereafter pushes forward while the other foot is being positioned to be placed on the ground in preparation for carrying out the same sequence of events. As the heel strikes the ground a large force is exerted through the heel of the runner and up through the leg, such force approximating the weight of the runner. It is this force that can both tire the runner or injure the foot and leg during running. In particular, such tiring or injury can be aggravated with running on hard or artificial surfaces such as those on which sports are conducted today and those encountered by joggers as they run along streets and sidewalks. However, the mere running on hard ground or even grass can also result in large forces not otherwise encountered being exerted through the heel and leg bones of the runner.

The present invention has a primary object of providing an athletic shoe rendering added support and cushioning for the foot particularly for running on hard surfaces.

SUMMARY OF THE INVENTION

An athletic shoe having an upper portion formed to contain the foot of the wearer and a sole fixed to the upper portion for contacting the ground. The sole includes an intermediate cushioning pad and a plurality of cleats extending from the lower surface to contact the ground with such cleats being particularly configured in the heel region to provide stability and effective cushioning of the heel during running.

DESCRIPTION OF THE DRAWINGS

FIG. 3 shows the shoe bending as the runner rolls forward upon the toe;

FIG. 4 shows the shoe as the runner places the heel of the lead foot on the ground;

FIG. 7 shows a second embodiment of a cleat having additional shear resisting properties; and FIG. 8 is a top plan view of the cleat of FIG. 7.

DESCRIPTION OF THE INVENTION

Figure 1:
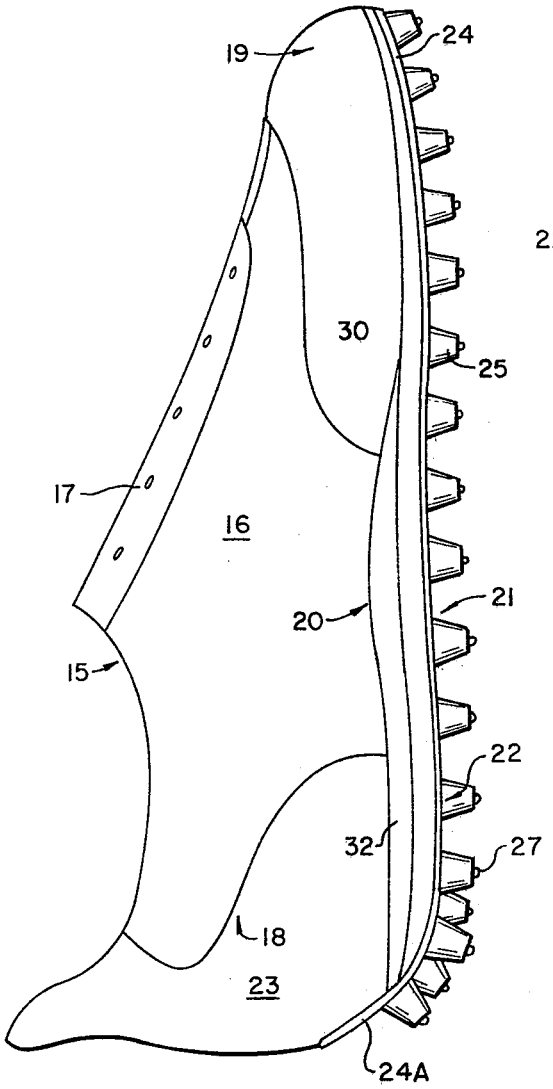
FIG. 1 is a side view of an athletic shoe embodying the present invention.

As shown primarily in FIG. 1 the invention is embodied in an athletic shoe 15 comprising an upper portion 16 formed to enclose the foot of the wearer. The shoe is of a normal configuration with the upper portion usually being formed of leather or nylon and being adapted for lacing by shoestrings passed through the eyelets 17. The upper portion includes a heel portion 18, a toe portion 19 and a center or shank portion 20 which supports the arch and ball areas of the foot. The upper portion 16 extends downward to a sole 21 which forms the wear surface for contact with the ground. The upper portion also includes a heel counter 23 formed to enclose and support the heel. The sole is fixed to the upper portion in a suitable manner such as by gluing or sewing to complete the shoe.

Figure 2:
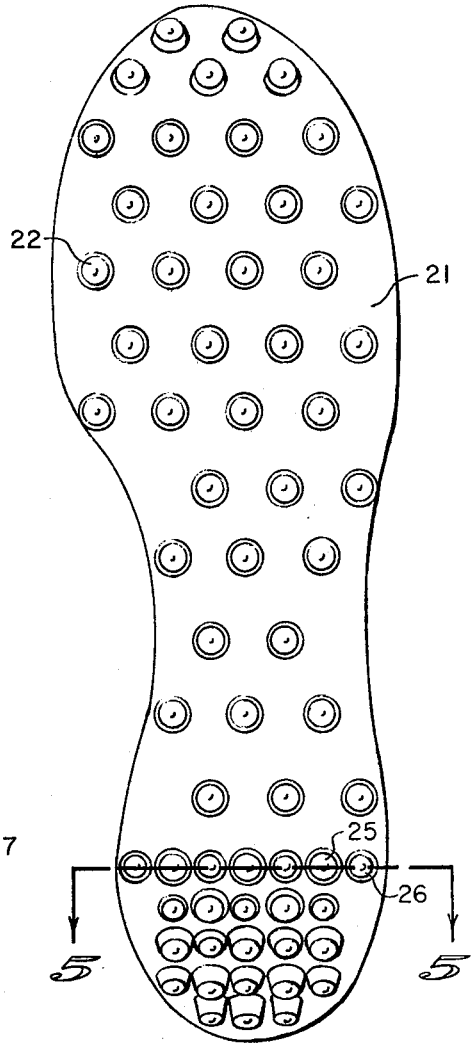
FIG. 2 is a view of the sole of the shoe shown in FIG. 1.
Figure 5:
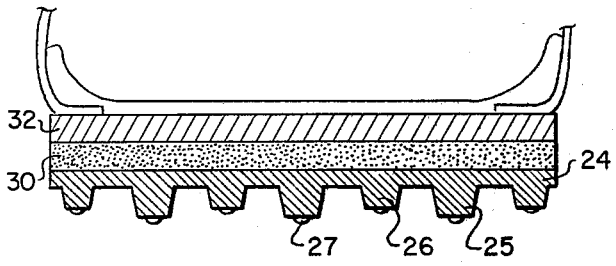
FIG. 5 is a cross-sectional view along line 5—5 in FIG. 2.

In accordance with one feature of the invention there are provided cleats 22 fixed to a bottom layer 24 of the sole which cleats extend downward and provide both a wear surface and traction for contact with the ground. As shown also in FIG. 2, the cleats include a plurality of truncated cone-shaped lugs 25 which are dispersed substantially uniformly across the bottom of the sole between the toe and up around a portion of the heel of the sole. The layer 24 also includes an end 24A extending up around the heel of the shoe. The cleats in the embodiment of FIG. 1 as shown primarily in FIG. 5 preferably are molded integrally with the layer 24.

In the normal manner of running, the heel is set down first and thereafter the foot is rolled forward up onto the toe for pushing forward. As pointed out before, a force substantially equal to the weight of the runner is transmitted up through the heel as the lead foot is set down on the ground which force must be sustained by the heel and the leg. In addition it is important there be provided sufficient traction and a stable support between the runner's heel and the ground. In accordance with this feature of the invention there are provided additional means for cushioning the forces encountered as the heel is set onto the ground. This means comprises interspersing in the heel area of the sole a plurality of large cleats 25 as described before and a plurality of smaller cleats 26 being of a shorter length. All of the cleats are formed with a truncated conical configuration which upon being compressed as the shoe is set onto the ground, assume a cylindrical configuration. As shown primarily in FIG. 6, the cleats compress as they transmit the weight of the wearer to the ground and withstand the shear forces exerted thereon as the runner pushes forward. In addition as the heel is set down other shear forces tending to bend the cleats to the side are withstood by the truncated cone configuration wherein the base of the cleat is wider than the extending end.

By the location of cleats of varying heights in the heel portion of the sole, a prolonged cushioning effect is provided during running. As shown primarily in FIG. 4, as the heel is set down the longer cleats 25 first contact the ground and are compressed. As more weight is transferred through the cleats, they shorten or assume the cylindrical configuration until the shorter cleats 26 initiate contact with the ground. These shorter cleats exert a further cushioning effect to the foot of the wearer and additionally because of the fact that they are shorter, further resist the shear forces between the foot and the ground to render a more stable platform for the runner. In the embodiment shown, the lugs are all provided with a slight middle extension 27 for additional traction and also to indicate wear areas of the sole for indicating how the foot is contacting the ground.

Figure 6:
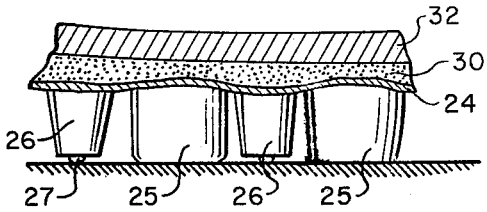
FIG. 6 shows the compression of the cleats as the weight of the runner is exerted through the heel of the shoe.

In accordance with another feature of the invention the layer 24 carrying the cleats is backed by an intermediate cushioning pad 30 which extends from the heel to the toe of the shoe for further absorbing shock between the foot and the ground. As shown in FIG. 6, this intermediate pad is resilient and will compress opposite the point of attachment of the individual cleats to distribute the force carried by that cleat across a greater area of the foot. This pad is sufficiently resilient to permit the proper bending of the shoe as is necessary for walking and running and preferably is thinner at the forward and back edges in the toe and heel portions of the shoe. Thus in addition to cushioning the foot in the area of the cleats, the intermediate pad further distributes all forces exerted between the foot and ground, especially in the heel.

In accordance with another feature of the invention there is included intermediate the pad 30 and the shoe upper portion 16 a stabilizing layer 32 which extends from the heel of the shoe down to the point of initiation of the toe area thereof. The stabilizing layer 32 comprises a resilient yet flexible layer having greater stiffness than the pad 30 for greater support of the foot in the heel and intermediate area. This stabilizing area tapers down to a more narrow thickness towards the front or toe portion of the shoe to allow slightly more bending in the forward areas of the foot. Thus the stabilizing layer further distributes throughout the bottom of the foot of the wearer the forces initiated through the cleats and partially distributed by the cushioning pad. By terminating the stabilizing layer prior to the toe area of the shoe, bending of the shoe is not prohibited or limited as illustrated in FIG. 3 which bending is necessary to the runner as he pushes off prior to lifting the rear foot in preparation for moving that foot forward.

Thus it can be seen that there is provided a combination of elements forming an effective athletic shoe particularly adapted for running or jogging. By the use of cleats of varying heights a cushioning effect is provided. The cleats provide greater traction, however, the normal drawbacks to cleats has been that if they are sufficiently hard so as to withstand the shear forces necessary for providing a stable platform for the runner, the cushioning effect is not sufficient.

In the present invention the cleats are made in a truncated cone configuration which will compress into an approximate cylinder configuration providing good stability against shear forces yet providing a satisfactory cushioning effect. In the heel area where cushioning is most needed during running and also where traction is necessary because of the smaller sole area in contact with the ground, the cleats are formed in a plurality of heights to both cushion the ground impact and withstand the shear forces commonly occurring. While only two lengths of cleats are shown in this embodiment, it would be possible to incorporate any number of varying heights which would also provide a further continuance of the progressive cushioning effect described heretofore. The inclusion of the intermediate pad 30 in cooperation with the stabilizing layer 32 further distributes the forces across the foot while providing a stable platform for the wearer. In addition, bending in the toe region is not limited because the stabilizing layer terminates near the ball of the foot.

In accordance with a second embodiment of the invention, there is shown in FIGS. 7 and 8 a different configuration for a cleat which can be used in an athletic shoe of this type. While this cleat includes a central body 34 having a truncated cone configuration, it also includes a plurality of stabilizing wall members 35 tapered for attachment to the bottom surface of the sole. These wall members 35 provide additional stability for withstanding the shear forces encountered and transmitted through the cleats while still providing the advantages of the cleats previously described for cushioning the contact between the foot and the ground or running surface.

The invention claimed:

1. An athletic shoe comprising in combination:

a shoe upper portion having heel, shank and toe areas and forming a cavity for receiving the foot;

a sole attached to said shoe upper portion for supporting the foot on the running surface, said sole comprising;

a cushioning pad of resilient material fixed to the upper portion;

a plurality of compressible cleats fixed to the bottom side of said cushioning pad and projecting downward to contact the running surface, said cleats being distributed throughout the area of the sole between the heel and the toe portions of the shoe; and said cleats at the heel portion of the shoe being of at least two different heights and being intermingled such that the longer cleats will contact the running surface first to provide a first cushioning action and upon compression, will permit the shorter cleats to contact the running surface to provide additional cushioning action for the foot.

2. An athletic shoe as defined in claim 1 wherein said cleats are of a truncated cone configuration with the area of smaller diameter extending downward to contact the running surface.

3. An athletic shoe as defined in claim 2 wherein at least some of said cleats include stiffening members extending from the sides thereof to enable the cleats to withstand shear forces exerted on the shoes striking the running surface.

4. An athletic shoe comprising in combination:

a shoe upper portion having heel, shank and toe areas and forming a cavity for receiving the foot;

a sole attached to said shoe upper portion for supporting the foot on the running surface, said sole comprising:

a cushioning pad of resilient material fixed to the upper portion;

a plurality of cleats fixed to the bottom side of said cushioning pad and projecting downward to contact the running surface, said cleats being distributed throughout the area of the sole between the heel and the toe portions of the shoe; and said cleats at the heel portion of the shoe being of at least two different heights and being intermingled such that the longer cleats will contact the running surface first to provide a first cushioning action and upon compression, will permit the shorter cleats to contact the running surface to provide additional cushioning action for the foot; and a stabilizing layer of resilient material positioned between the upper portion and the cushioning pad and extending along the heel and shank areas and terminating prior to reaching the toe area.

5. An athletic shoe as defined in claim 4 wherein said stabilizing layer is a resilient material having a stiffness exceeding that of the cushioning pad to provide additional support for the foot in the heel and shank areas.

6. An athletic shoe as defined in claim 5 including a heel counter forming the portion of the shoe upper portion enclosing the heel of the shoe to grip the heel of the wearer.

7. An athletic shoe as defined in claim 4 wherein said cleats in the heel portion of the sole are truncated cone-shaped with the larger area positioned adjacent the cushioning pad.

* * * * *